US008773954B1

(12) United States Patent
Ruffa

(10) Patent No.: US 8,773,954 B1
(45) Date of Patent: Jul. 8, 2014

(54) ACOUSTIC SOURCE REACTIVE TO TOW CABLE STRUM

(71) Applicant: Anthony A. Ruffa, Hope Valley, RI (US)

(72) Inventor: Anthony A. Ruffa, Hope Valley, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 175 days.

(21) Appl. No.: 13/623,932

(22) Filed: Sep. 21, 2012

(51) Int. Cl.
*B06B 3/00* (2006.01)

(52) U.S. Cl.
USPC ..... 367/142

(58) Field of Classification Search
USPC ..... 367/142, 143, 152, 106, 130
See application file for complete search history.

(56) References Cited

U.S. PATENT DOCUMENTS 3,860,899 A * 1/1975 Watlington ..... 367/130
4,267,585 A * 5/1981 Georgallis ..... 367/130
5,274,603 A * 12/1993 Zibilich et al. ..... 367/154
5,757,721 A * 5/1998 Hull ..... 367/130

* cited by examiner

*Primary Examiner* — Daniel Pihulic
(74) *Attorney, Agent, or Firm* — James M. Kasischke; Michael P. Stanley

(57) ABSTRACT

A device operable as a transducer is provided for use in which the device is mountable on a tow cable which in operation extends underwater substantially throughout the length thereof. The device comprises a head mass encompassing the tow cable wherein the head mass reacts to a wave-like strumming configuration about an axis of the tow cable thereby causing the tow cable to be displaced in one direction, along the axis and then in an opposite direction such that a low frequency continuous sound wave radiates from the head mass.

9 Claims, 3 Drawing Sheets

ACOUSTIC SOURCE REACTIVE TO TOW CABLE STRUM

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention relates to a transducer-like device capable of clamping onto a tow cable. The device is responsive to the tow cable vibrating over the length of the cable such that the vibrating tow cable is an energy source for the device. A typical long cable that strums over a length supports vibrational energy produced by transverse waves of relatively short wavelengths and longitudinal energy produced by much longer longitudinal waves.

(2) Description of the Prior Art

Cable strum occurs because of vortex shedding from a cable towed at an angle with respect to the flow around the cable. A tow cable supports both transverse waves and longitudinal waves. The transverse waves tend to have short wavelengths: their propagation speed "c" (in meters per second) is approximately $c=\sqrt{Tg/W}$; where "T" is the tension in Newtons; "W" is the weight per unit length and "g" is acceleration due to gravity, or 9.81 $m/s^2$ (wherein "m" is meters and "s" is seconds). In water, W includes the weight of the added mass, which is equal to the weight of the displaced water.

Conversely, longitudinal waves have much longer wavelengths because of a propagation speed governed by $c=\sqrt{E/\rho}$, where "E" and "ρ" are respectively the Young's modulus (having units of Newtons per square meter) and density (having units of kilograms per cubic meter) of the cable. As a result, on the order of one to ten longitudinal waves are contained by a mile-long tow cable.

Each transverse wave creates a localized region of curvature in the cable that shortens the cable (FIG. 1). The cable shortening generates longitudinal waves that exhibit twice the frequency of the transverse waves because the cable is shortened twice during each transverse wave cycle (FIG. 2). This is sometimes referred to as the frequency doubling effect.

The transverse wave frequency is governed by the formula for the Strouhal frequency, i.e., $fs=0.2\,U\sin\theta/d$, where "U" is the tow speed, (in meters per second), "θ" is the incidence angle (in degrees) with respect to the flow, and "d" is the cable diameter (in inches).

Towed arrays typically include a steel cable that is approximately a mile long. The movement for such a cable is nearly straight over an entire length and at a critical angle. The critical angle is the angle at which the weight of the cable in water balances the drag of the cable. The critical angle is determined by the equation:

$$\frac{1}{2}(\sigma-1)\pi g d\cos\theta = (C_D\sin\theta + \pi C_N)U^2\sin\theta \tag{1}$$

where σ is the specific gravity of the cable, "$C_D$" is the normal drag coefficient (≈1.5 for a cylindrical cable); $C_N=0.75C_T$; and $C_T=0.0025$.

Equation (1) can be solved for θ for any given tow speed. The Strouhal frequency formula ($fs=0.2\,U\sin\theta/d$) then indicates that the vortex shedding frequency (which is the same as the Strouhal frequency) is nearly constant over a wide speed range (e.g., approximately 6 Hz for a one-inch diameter steel tow cable). This occurs because θ is small enough so that the small angle approximations are valid (i.e., $\sin\theta\approx\theta$, $\cos\theta\approx1$, and the $\sin^2\theta$ term can be neglected compared to the $\sin\theta$ term). As a result, Equation (1) becomes a linear equation in θ, to the first order. When these assumptions are valid, the incidence angle θ becomes approximately $$\theta \approx \frac{(\sigma-1)gd}{2C_N U^2}. \tag{2}$$

In practice, this result has been verified in sea tests when the strum frequency was measured as a function of tow speed. The 6 Hz transverse waves in the cable then lead to 12 Hz longitudinal waves (because of the frequency doubling effect).

A mile long tow cable that is strumming over an entire length supports a substantial amount of vibration energy (i.e., the vector dot product of force and displacement). In operating tests, such cables have been observed to vibrate with transverse amplitudes of approximately six inches under a cable tension of over one thousand pounds.

SUMMARY OF THE INVENTION

Accordingly, it is a primary purpose and general object of the present invention to harness the vibrational energy of a tow cable.

To attain the object described, a feature of the present invention is a transducer-like device adapted: to be clamped onto a tow cable; to vibrate in directions normal to the device; and to radiate sound into water at high amplitudes and low frequencies as the result of the device reacting to the influence of cable strum.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent, wherein corresponding reference characters indicate corresponding parts throughout the views of the drawings, and wherein.

DETAILED DESCRIPTION OF THE INVENTION

Figure 1:
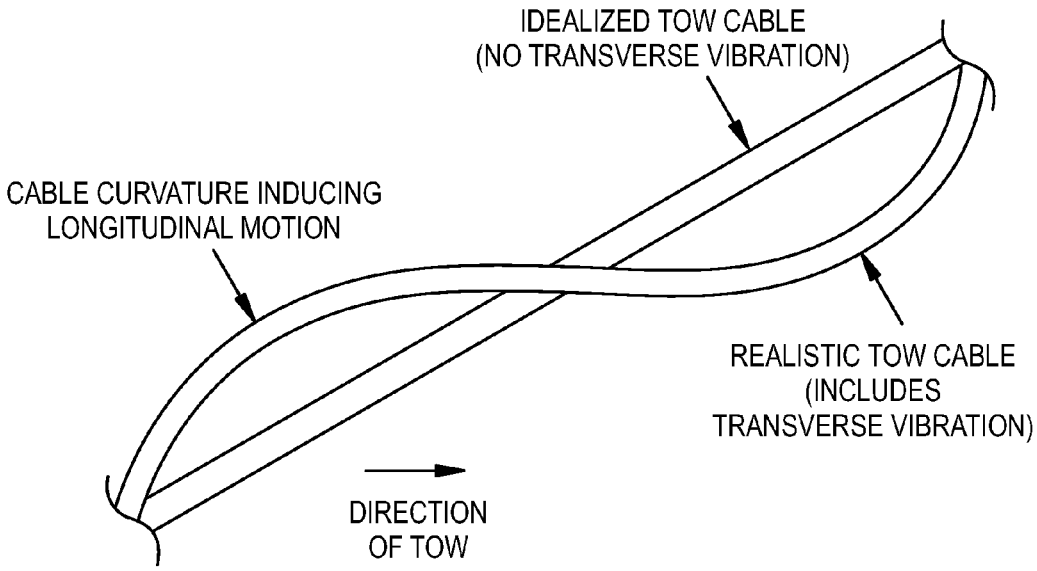
FIG. 1 (PRIOR ART)
FIG. 1 illustrates that each transverse wave creates a region of curvature in the cable with the result of shortening the cable.
Figure 2:
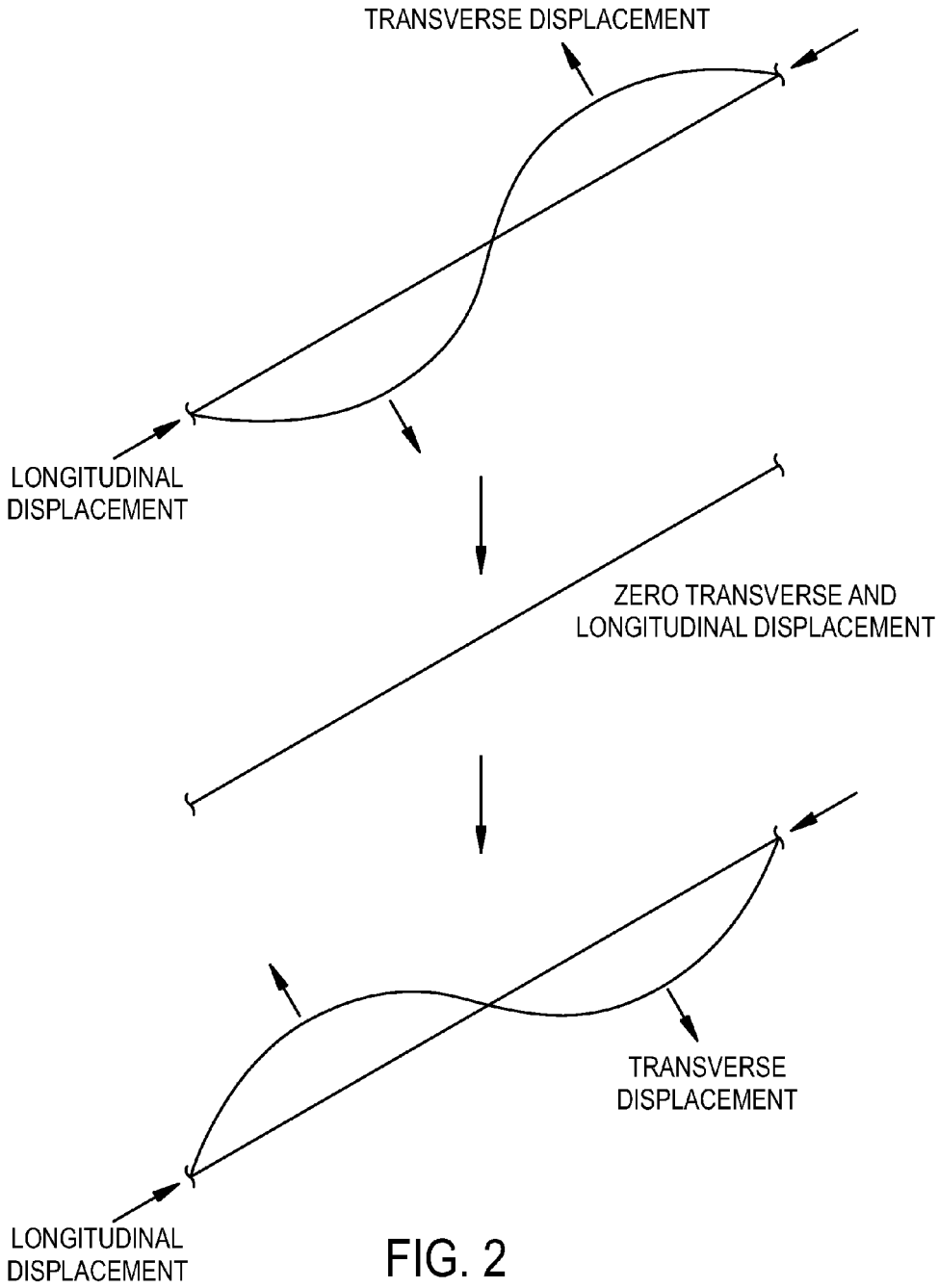
FIG. 2 (PRIOR ART)
FIG. 2 illustrates that the shortening of the cable generates longitudinal waves that have twice the frequency of the transverse waves with the cable being shortened twice during each transverse wave cycle.
Figure 3:
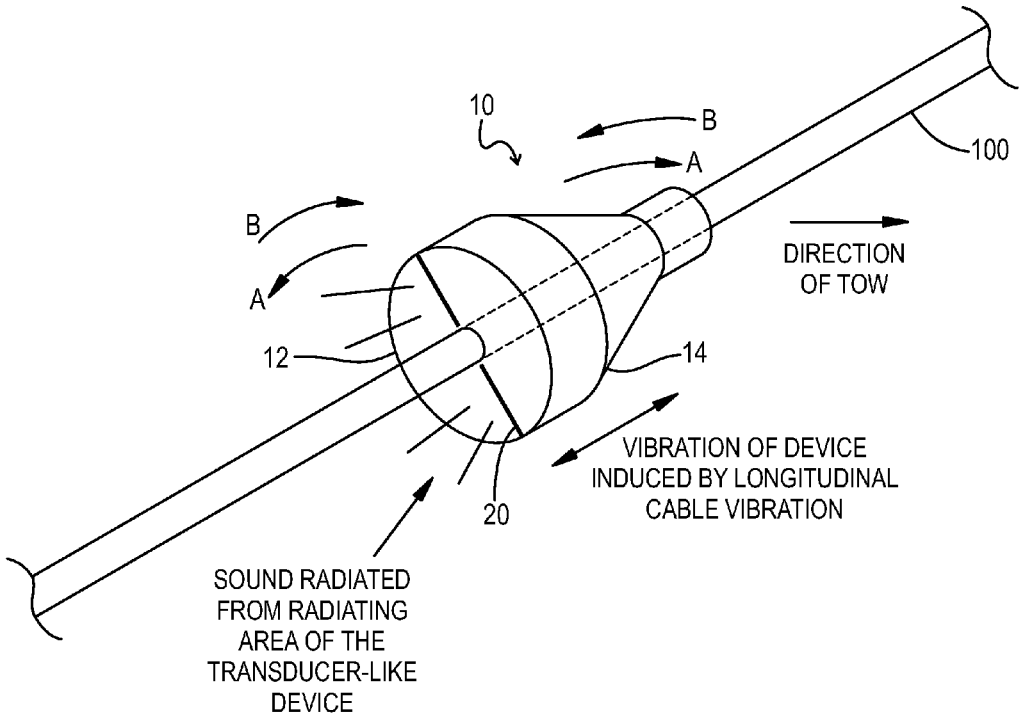
FIG. 3 is an illustration of a transducer-like device of the present invention harnessing vibrational energy from the tow cable.

Referring now to the drawings, a transducer-like device 10 is shown in FIG. 3 in which the device is clamped to a tow cable 100 and which resembles a head mass of a Tonpilz transducer. The device 10 can be made of steel or any other material appropriate for a transducer head mass.

A Tonpilz transducer typically comprises a stack of piezoelectric elements between a radiating head mass and a heavy tail mass (such as a ship). In the present invention, the piezoelectric stack of a Tonpilz transducer that generates vibrational energy is replaced by the mile long tow cable 100 that generates vibrational energy along a length of the cable. The towing ship (not shown) acts as the heavy tail mass and the device 10 acts as the head mass. It is more practical to deploy the cable 100 with the attached device 10; than to deploy an equivalent Tonpilz transducer in which the large size of the Tonpilz transducer is highly-impractical if not impossible for use.

In use, the longitudinal vibration of the cable 100 causes the device 10 to vibrate in a direction normal to a flat surface of the device. This vibration radiates sound at 12 Hz at high amplitudes. At frequencies this low, diffraction causes the device 10 to be an omni-directional source, as the wavelength of the radiated sound in the water is about 125 meters at 12 Hz.

As the cable 100 is displaced sideways by six inches in one direction, and then six inches in another direction; the end mass moves in and back out to an original position—twice for each transverse cycle. As the cable 100 is typically under a thousand pounds (or more) of tension, and strums at high amplitudes, an end mass weighing several hundred pounds will vibrate under the influence of cable strum. Therefore, the force in the longitudinal direction will be high enough to drive a very powerful transducer.

In operation, the device 10 moves transverse because of transverse waves in the cable 100, but the motion-causing acoustic radiation is motion along the axis of the cable, generally in line with the longitudinal waves. Each transverse wave causes a shortening of the cable 100. The shortening of the cable 100, which occurs twice per transverse period, drives the longitudinal motion of the cable and causes sound radiation.

The radiating area of the device 10 can be adjusted to achieve a better match to the specific acoustic impedance of the water and to maximize the conversion of cable vibrational energy to sound radiated into the water. This is a common practice that is well known to designers of transducers (e.g., using both finite element models and experimental measurements).

Furthermore, acoustical sources enlarge as the frequency decreases. A conventional source, even one radiating at 100 Hz, is typically too large for a practical system. This source, although large, takes advantage of vibrational phenomena that occur naturally in existing systems; the tow cable imposes no additional burden in terms of handling systems.

Accordingly, there is provided a transducer-like device 10 for use in an underwater tow assembly for surface ships and unmanned surface vehicles. The device 10 is adaptable to be mounted (or clamped) on a tow cable and to extend underwater substantially throughout the length thereof in a wave-like strumming configuration about a generally straight line axis.

The device 10 comprises a head mass adapted to be affixed to the tow cable 100 and configured to vibrate along the axis as the tow cable is displaced in one direction, sideways of the cable, and then in an opposite direction, to radiate a low frequency continuous sound wave source at high acoustic levels. The head mass comprises a generally cylindrically shaped first portion defining a substantially flat sound-radiating end surface, generally normal to an axis of the tow cable, and a second portion of a lesser end surface. The head mass further comprises a generally frusto-conical portion between the first and second portions and having a flat aft surface.

The head mass as the device 10 can comprise two sections 12, 14 that separate in a direction "A" away from the tow cable 100. Contact line 20 is shown to illustrate a partition plane. Conversely, the sections 12, 14 can be assembled at the contact line 20 in direction "B" to join the sections in an interlocking manner by methods and attaching components known to those skilled in the art.

Partitioning the head mass is not limited to two sections. Depending on the operating requirements and environment; numerous partitioning into three, four, and additional sections can be accomplished by attachment and separation methods also known to those ordinarily skilled in the art.

The head mass is adapted to vibrate along the axis of the tow cable 100 and to direct sound from the first end surface centered generally along the cable. Also, the head mass is adapted to vibrate in a direction along the tow cable 100 in response to lengthwise cable vibration in order to generate the sound waves. A plurality of head masses can be clamped onto a cable—ideally spaced at one (longitudinal) wavelength intervals on the cable—for the possibility of more radiated sound.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A device reactive to acoustic strum of a tow cable, said device comprising:

a head mass encompassing the tow cable;

wherein said head mass reacts to a wave-like strumming configuration about an axis of the tow cable thereby causing the tow cable to be displaced in one direction, along the axis and then in an opposite direction such that a low frequency continuous sound wave radiates from said head mass.

2. The device in accordance with claim 1 wherein said head mass comprises:

a first cylindrically shaped portion defining a flat radiating end surface, normal to the axis of the tow cable and as a first end of said first portion with a second end as an opposite end of said first portion;

a frusto-conical portion having a first end facing the second end of said first cylindrically shaped portion and a second end of said frusto-conical portion opposite the first end of said frusto-conical portion wherein a diameter of the second end of said frusto-conical portion is less than a diameter of the first end of said frusto-conical portiona; and a second cylindrically shaped second portion facing the second end of said frusto-conical portion.

3. The device in accordance with claim 2 wherein said head mass is capable of partition into at least two sections with said sections separated on plane perpendicular to the axis of the tow cable.

4. The device in accordance with claim 3 wherein each of said sections is attachable to an opposite section at the plane perpendicular to the axis of the tow cable.

5. A system for harnessing vibrational energy of a tow cable; said system comprising:

a plurality of head masses with each of said head masses encompassing the tow cable wherein each of said head masses react to a wave-like strumming configuration about an axis of the tow cable thereby causing the tow cable to be displaced in one direction, along the axis and then in an opposite direction such that a low frequency continuous sound wave radiates from each of said head masses.

6. The system in accordance with claim 5 wherein each of said head masses is separable by one longitudinal wavelength.

7. The device in accordance with claim 6 wherein each of said head masses comprises:

a first cylindrically shaped portion defining a flat radiating end surface, normal to the axis of the tow cable and as a first end of said first portion with a second end as an opposite end of said first portion;

a frusto-conical portion having a first end facing the second end of said first cylindrically shaped portion and a second end of said frusto-conical portion opposite the first end of said frusto-conical portion wherein a diameter of the second end of said frusto-conical portion is less than a diameter of the first end of said frusto-conical portiona; and a second cylindrically shaped second portion facing the second end of said frusto-conical portion.

8. The device in accordance with claim 7 wherein each of said head masses is capable of partition into at least two sections with said sections separated on plane perpendicular to the axis of the tow cable.

9. The device in accordance with claim 8 wherein each of said sections is attachable to an opposite section at the plane perpendicular to the axis of the tow cable.

* * * * *